US009384935B2

(12) United States Patent
Arnold et al.

(10) Patent No.: US 9,384,935 B2
(45) **Date of Patent: *Jul. 5, 2016**

(54) CATHODE STRUCTURES FOR X-RAY TUBES

(75) Inventors: James T. Arnold, Cupertino, CA (US); Steve Bandy, Sunnyvale, CA (US); Gary Virshup, Cupertino, CA (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/369,678

(22) Filed: Feb. 9, 2012

(65) Prior Publication Data

US 2012/0140896 A1 Jun. 7, 2012

Related U.S. Application Data

(60) Division of application No. 12/759,621, filed on Apr. 13, 2010, now Pat. No. 8,174,174, which is a continuation of application No. 11/350,975, filed on Feb. 8, 2006, now Pat. No. 7,795,792.

(51) Int. Cl.
*H01J 1/13* (2006.01)
*H01J 35/06* (2006.01)

(52) U.S. Cl.
CPC ..... *H01J 35/06* (2013.01); *H01J 2235/06* (2013.01)

(58) Field of Classification Search
CPC ..... H01J 1/15; H01J 35/06; H01J 2235/06; H01J 2235/062
USPC ..... 313/346 DC, 346 R
See application file for complete search history.

(56) References Cited

U.S. PATENT DOCUMENTS

| | | | | |
|---|---|---|---|---|
| 3,846,006 | A | | 11/1974 | Atlee et al. |
| 4,143,295 | A | * | 3/1979 | Oguro ..... 313/346 R |
| 4,533,852 | A | * | 8/1985 | Frank et al. ..... 313/346 DC |
| 4,866,749 | A | | 9/1989 | Uematu |
| 4,885,043 | A | * | 12/1989 | Al-Jaroudi ..... 148/278 |
| 5,105,456 | A | | 4/1992 | Rand et al. |
| 5,336,973 | A | | 8/1994 | Leroux et al. |

(Continued)

FOREIGN PATENT DOCUMENTS

| | | |
|---|---|---|
| DE | 683559 | 11/1939 |
| DE | 1231357 | 12/1966 |

(Continued)

OTHER PUBLICATIONS

PCT Search Report mailed May 21, 2008; PCT/US07/02661.

(Continued)

*Primary Examiner* — Karabi Guharay
(74) *Attorney, Agent, or Firm* — Maschoff Brennan

(57) ABSTRACT

An apparatus and method comprising a cathode structure which can be a cylindrical filament coiled in a helix or which can be constructed of a ribbon or other suitable shape. The cathode structure can be heated by passage of an electrical current, or by other means such as bombardment with energetic electrons. Selected portions of the surface of the cathode structure have an altered property with respect to the non-selected portions of the surface. In one embodiment, the altered property is a curvature. In another embodiment, the altered property is a work function. By altering the property of the selected portions of the surface, the electron beam intensity is increased, and the width is decreased.

4 Claims, 14 Drawing Sheets

(56) References Cited

U.S. PATENT DOCUMENTS

| | | | | |
|---|---|---|---|---|
| 5,412,281 | A | 5/1995 | Farney et al. | |
| 5,484,263 | A | 1/1996 | Nagaraj et al. | |
| 5,580,291 | A | 12/1996 | Redel et al. | |
| 5,742,061 | A | 4/1998 | Lemonnier et al. | |
| 5,911,919 | A | 6/1999 | Billings | |
| 6,004,830 | A | 12/1999 | Potter | |
| 6,215,247 | B1 * | 4/2001 | Kurano ..... | G03F 7/70016 313/631 |
| 6,495,949 | B1 | 12/2002 | Park et al. | |
| 6,987,835 | B2 | 1/2006 | Lovoi | |
| 2005/0232396 | A1 | 10/2005 | Chidester | |

FOREIGN PATENT DOCUMENTS

| | | |
|---|---|---|
| DE | 4421793 | 1/1996 |
| JP | 57019942 | 2/1982 |
| JP | 4101339 | 4/1992 |
| JP | 05120992 | 5/1993 |
| JP | 8335435 | 12/1996 |
| JP | 11111215 | 4/1999 |
| JP | 200447365 | 9/2005 |

OTHER PUBLICATIONS

Varian, PCT Search Results dated May 21, 2008 of PCT/US07/02661.

* cited by examiner

CATHODE STRUCTURES FOR X-RAY TUBES

RELATED APPLICATION

This application is a divisional of co-pending U.S. patent application Ser. No. 12/759,621, filed Apr. 13, 2010, which is a continuation of U.S. patent application Ser. No. 11/350,975, filed Feb. 8, 2006, titled "Cathode Structures for X-Ray Tubes" issued as U.S. Pat. No. 7,795,792 on Sep. 14, 2010.

TECHNICAL FIELD

Embodiments of the present invention are generally related to the field of X-ray tube cathodes and more specifically related to electron emitting structures of X-ray tube cathodes.

BACKGROUND

Conventional coiled filaments of an X-ray tube have a close wound helical form, suspended in a channel, as shown in FIG. 1. A longitudinal view of the coil is shown in FIG. 2. Generally, the filament coil faces the anode of the tube, and the geometry of the electric field tends to spread, particularly near the filament coil where the electron energy is still low, leading to a spreading of the electron beam; and thus, reducing the electron beam intensity delivered to the anode. The spreading of the beam from a cathode surface with a convex curvature facing the anode, as shown in FIG. 2, is a well-known property of geometry for cylindrical filament coils. It should be noted that the spreading in FIG. 2 is exaggerated for accent. Spreading of the electron beam increases the width of the electron beam incident on the anode, decreases uniformity within the electron beam incident on the anode, and blurs the edge of the electron beam incident on the anode.

SUMMARY OF AN EMBODIMENT

An apparatus and method of a cylindrical filament coiled in a helix for a cathode of an X-ray tube having a surface is described. In one embodiment, selected portions of the surface have an altered property with respect to the non-selected portions of the surface of the cylindrical filament. In one embodiment, the altered property is a curvature. In another embodiment, the altered property is a work function. A goal of the alteration of the properties is to improve the definition and intensity of the electron beam incident on the anode of the X-ray tube.

In one embodiment, the curvature may be formed by grinding or cutting material away from the selected portions of the surface. In another embodiment, the curvature may be formed by bending the material of the selected portions of the surface.

In one embodiment, the surface of the cylindrical filament has a base filament material, which has an associated work function. In one embodiment, the work function is altered by depositing a film layer of material on the selected portions of the surface, which has abuse filament material. In one embodiment, the film layer of material has a lower work function than the base filament material of the non-selected portions. In another embodiment, altering the work function includes depositing a film layer of material on the non-selected portions of the surface, which has a base filament material. The film layer of material has a higher work function than the base filament material of the selected portions. Alternatively, altering the work function includes depositing a first film layer of material on the selected portions of the surface, and depositing a second film layer of material on the non-selected portions of the surface. The first film layer of material has a lower work function than the second film layer of material of the non-selected portions.

Additional features and advantages of the present embodiments will be apparent from the accompanying drawings, and from the detailed description that follows below.

BRIEF DESCRIPTION OF THE DRAWINGS

The present embodiments are illustrated by way of example and not intended to be limited by the figures of the accompanying drawings.

DETAILED DESCRIPTION

Figure 1:
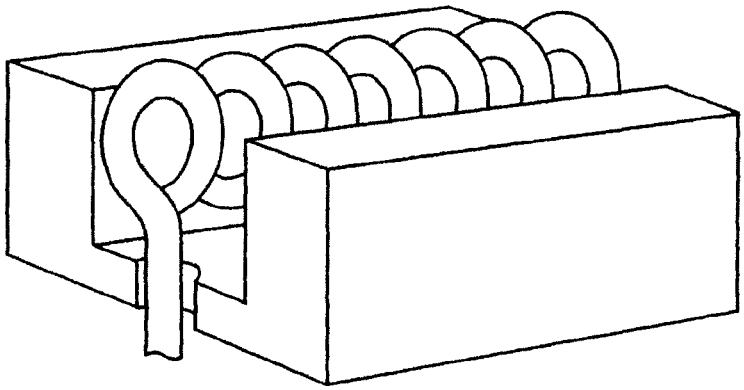
FIG. 1 (PRIOR ART)
FIG. 1 illustrates a conventional coiled filament of an X-ray tube having a helical form.
Figure 2:
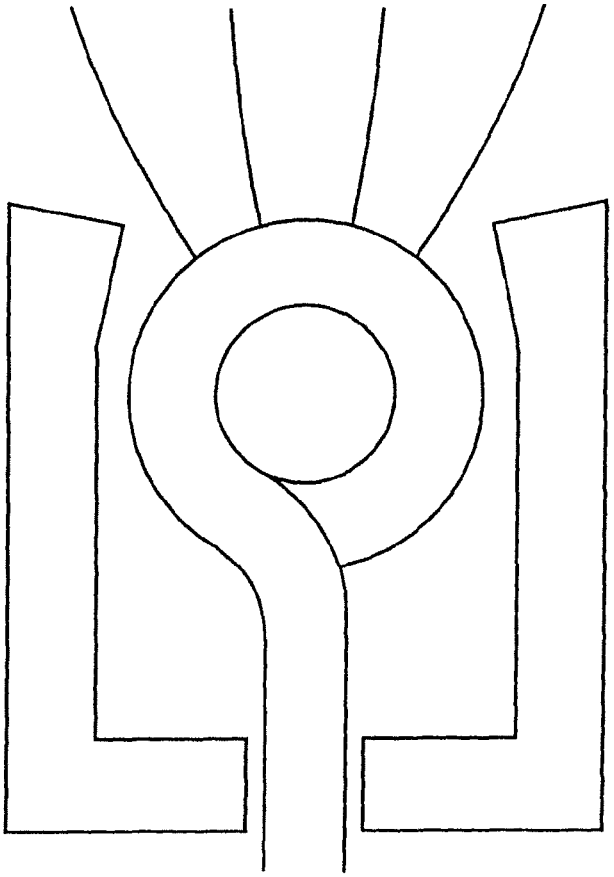
FIG. 2 (PRIOR ART)
FIG. 2 illustrates a longitudinal view of the coiled filament of FIG. 1.

In the following description, numerous specific details such as specific materials, processing parameters, processing steps, etc., are set forth in order to provide a thorough understanding of the invention. One skilled in the art will recognize that these details need not be specifically adhered to in order to practice the claimed embodiments. In other instances, well known processing steps, materials, etc., are not set forth in order not to obscure the invention. The term "work function" as used herein means the minimum amount of energy required to remove an electron from the surface of a metal.

A cathode is described. The cathode may be used in an x-ray tube to emit electrons which are accelerated to high energy required to generate x-rays when colliding with an anode. The cathode may be a cylindrical filament that may be coiled in a helix as described herein. The cylindrical filament is an electrical conductor, usually a wire, having a surface. The function of the surface is to provide a beam of electrons. The surface may have selected and non-selected portions. As described in more detail below, the selected portions of the surface have a property, which can be changed with respect to the non-selected portions of the surface.

The convex curvature in a typical coiled filament leads to spreading of the electron beam, and thus, reduces the electron beam intensity delivered to the anode. In one embodiment, the convex curvature of the coiled filament may be changed to a substantially flat or concave curvature on the top face of the coiled filament to provide a better geometry for the electron-emitting surface of the coiled filament, reducing spreading of the electron beam and increasing the electron beam intensity delivered to the anode. With the surface having a curvature in its contour, the cathode coil can be made such that the envelope tangent to the electron emitting surfaces has a concave contour, thereby resembling the geometry of a one-dimensional Pierce cathode, to focus electrons on the anode. The curvature may be formed, for example, by grinding, cutting, or bending contours of the surface within selected portions of the surface. Alternatively, other methods known to those skilled in the art can be used to form the required curvature along the selected portions of the surface.

In another embodiment, the work function may be altered on explicitly selected areas of the filament surface, for example, by depositing material to alter the work function on at least on one of the selected portions, or omitting the selected areas and depositing material on the non-selected areas, or depositing materials of differing work function on selected portions and non-selected portions both. This may be accomplished by operations that may convert the surface to a different compound from the base filament material. An example of one such operation is performed on a tungsten filament wire to carburize a surface layer of controllable depth in selected areas to decrease the work function thereon. Other surface modifying operations may also be used, to decrease or increase the work function, or otherwise alter the behavior of the surface in defined areas of the filament. Methods that are known to those skilled in the art can be used to change the difference in work function between the selected and non-selected portions of the surface, allowing the selected portions to have a lower work function than the non-selected portions of the surface.

A geometric definition of the selected portions of the cathode structure can be devised to improve the focus of the electron beam by increasing the electron flux from the areas having a reduced work function. With the smaller source area, the electron beam width can be made smaller and the beam edges can be made sharper, allowing a footprint on the anode having reduced area and sharper edge definition. Not withstanding the smaller electron beam footprint, the electron beam density can be higher, and the total X-ray production can be maintained. X-Ray image definition, in general, is determined by the X-ray source spot size. Increasing the electron beam intensity, and/or decreasing the width of the electron beam, causes the electron beam footprint incident on the anode to decrease in width, increase in uniformity, and include more definite the edges. By increasing the beam intensity and/or decreasing the electron beam width, the X-ray tube containing the filament described herein produces clearer, less blurred X-ray images.

An added advantage of defining the electron emitting area of the filament by altering the property of the selected portions of the surface of the cylindrical filament, described herein, lies in the fact that the electron beam intensity may be increased, and the definition and size of the beam footprint at the anode can be improved without additional focusing electrodes, which would require separate electrical excitation.

An X-ray tube generally includes an enclosure containing electrodes that accelerate and direct the electrons from a cathode filament to a metal anode, where their impact produces X-rays. A conventional X-ray tube is furnished with an enclosure, usually of glass or ceramic and metal construction enclosing a high vacuum in which electrons can be freely accelerated without excessive collisions with gas molecules. The cathode/filament releases electrons to the vicinity when heated with electric current. The electrons are accelerated to an anode, which produces X-rays when struck by the accelerated electrons. In some X-ray tubes, the anode is rotated in order to spread the heat due to the energy deposited by the high energy electrons impinging. The rotating anode inside the tube includes a rotor of an induction motor devised to rotate the anode. The stator of the induction motor is usually situated outside the tube. The X-ray tube envelope may be provided with a window made from a low density material to permit the exit of the X-rays generated by the X-ray tube. The window may have a higher density boarder to define the boundary of the output X-ray beam.

Figure 3:
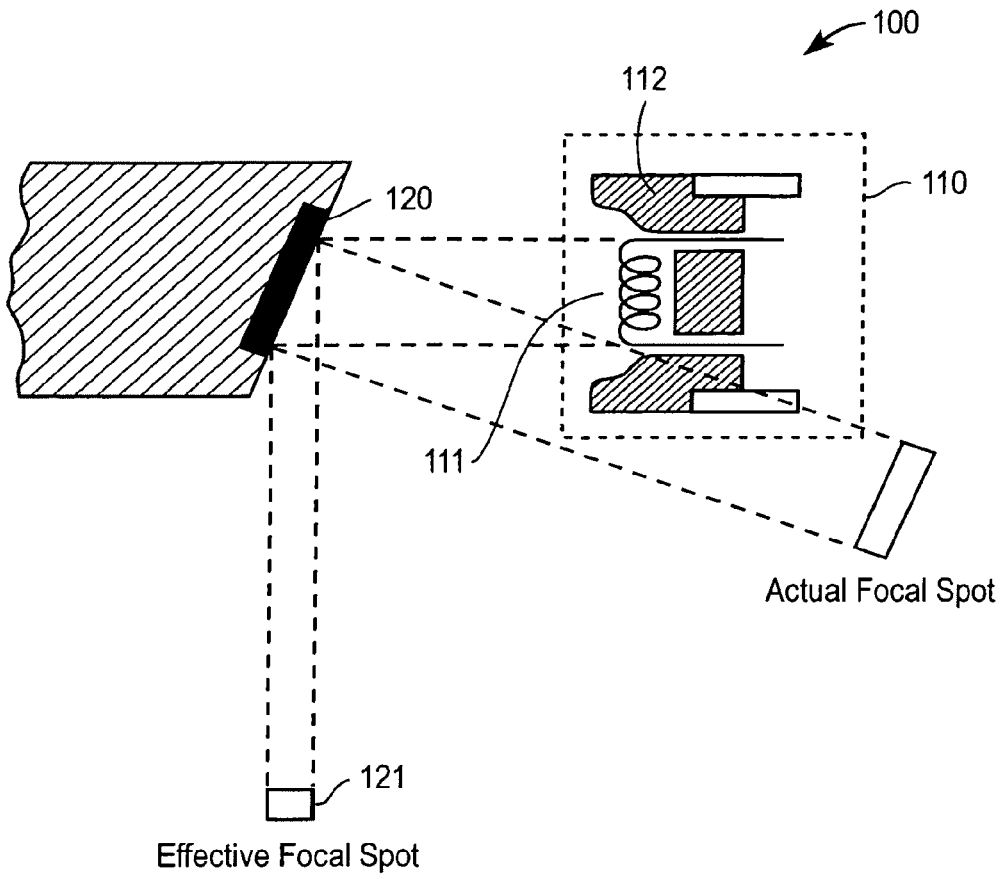
FIG. 3 illustrates one embodiment of an X-ray tube including a cathode and an anode.

FIG. 3 illustrates one embodiment of an X-ray tube having a cathode and an anode. X-ray tube 100 of FIG. 3 includes cathode structure 110 and anode 120. Cathode structure 110 may include an electrically conducting filament 111 and filament housing structure 112. Filament 111 may be a cylindrical wire coiled in a helix shape. Filament 111 includes a surface. The filament 111 when heated sufficiently by means of the passage of electric current releases electrons from the surface. Subsequently, the electric field between the cathode structure 110 and the anode 120 arising from the application of a high voltage in the range from a few thousand to several hundred thousands of volts between the cathode structure 110 and the anode 120 of said X-ray tube 100 accelerates the electrons in the direction of the anode.

The accelerated electrons make up an electron beam, which has an electron beam intensity, width, and length. The beam length is dependent on the distance between the cathode structure 110 and the anode 120. The beam energy and width are defined by the electric fields existing between the cathode structure 110 and anode 120. It should be noted that the electrons are released from the surface of the filament 111 at low energy. In this condition, they are susceptible to easy manipulation by the electrical fields present. By combining the ease of manipulation and the geometry of the area assigned to be the source of electrons in the beam and the ease of manipulation of the electron trajectories, particularly when the energy is low, using the methods and structures described herein, the width of the electron beam may decrease, and the electron beam's intensity may increase. Increasing the intensity and decreasing the width of the electron beam creates a smaller footprint of the electron beam incident on the anode.

A vitiating influence on the control of the electron beam lies in the mutual electrostatic repulsion of the electrons which tends to cause the beam to diverge or spread. As the electrons are accelerated by the intense electrical field between the cathode structure 110 and the anode 120, they are less susceptible to transverse accelerations, and the beam can be held more tightly to a desired narrow footprint.

The high electrical field that is required to accelerate the electrons as they move to the anode is furnished by a high voltage power supply. The usual power supply comprises a transformer adapted to provide a high voltage alternating current source from commercial power lines. In most cases, the alternating current source is rectified by high voltage rectifiers, either vacuum tube or semiconductor. Note that numerous alternative means to generate the high voltage supply are well-known in the art of making x-rays. With the application of the rectified high voltage, electrons are first quickly accelerated to high energy. Upon reaching the anode, the electrons are abruptly stopped. For a small fraction of the electrons, the very severe stopping process produces X-rays. The X-rays originate from the footprint of the electron beam where it strikes the anode. To form a narrow X-ray beam with sharp boundaries, the footprint should be as small as possible; thus the importance of providing a small footprint of the electron beam on the anode.

Anode 120 may be configured to receive electrons emitted from the surface of the cylindrical filament 111. The anode may be disposed so as to present a face inclined to the direction of the electron beam. X-rays are produced under the footprint of the electron beam and are distributed isotropically from the collective points of electron collisions. For angles less than 90 degrees from the normal to the anode face, the X-rays are free to emerge. In particular, according to FIG. 3, X-rays emerge along the path 121. As it appears, the focal spot, which has the width at 120 of the incident electron beam, is viewed from the standpoint of the X-rays with a foreshortened width as the beam 121. The electron beam shaping may be devised to furnish a rectangular footprint at the anode. In this arrangement, the X-rays produced by the electron beam footprint, viewed from the direction of the exit X-ray beam 121, at the appropriate angle will be seen as having a small square profile. Angles appropriate to this arrangement generally fall in the range of 0° to 20°. This geometry permits spreading the area on the anode that receives the energy of the electron beam, thereby reducing the local heating of the anode face. In one exemplary embodiment the angle of the anode is approximately 7 degrees. Alternatively, other angles may be used. The footprint of the electron beam can be made rectangular with the long axis disposed in the direction of the output X-ray beam. This rectangle, when viewed in the direction of the output X-ray beam is foreshortened so as to furnish a smaller apparent origin for the X-rays seen in cross section 121. Such an arrangement may help reduce heating and erosion of the anode 120.

Filament housing structure 112 of cathode structure 110 encases filament 111. Filament housing structure 112 may shape the electric fields in the vicinity of the cathode and between the cathode 110 and the anode 120, which may influence the path of the electrons from the cathode 110 to the anode 120. More specifically, the shape of filament housing structure 112 can influence the early shaping of the beam. A specific allusion to the shaping is made.

As described above, the cathode may comprise a filament 111 which may be a cylindrical wire coiled in a helix to furnish the electron emitting element of the cathode structure 110 of an X-ray tube 100. The surface of the cathode may have selected portions with altered features with respect to the non-selected portions of the surface. In one embodiment, the altered feature of the selected portions of the surface may be the curvature along the selected portions of the surface. The curvature of the selected portions may be substantially concave, flat, or convex.

Figure 4A:
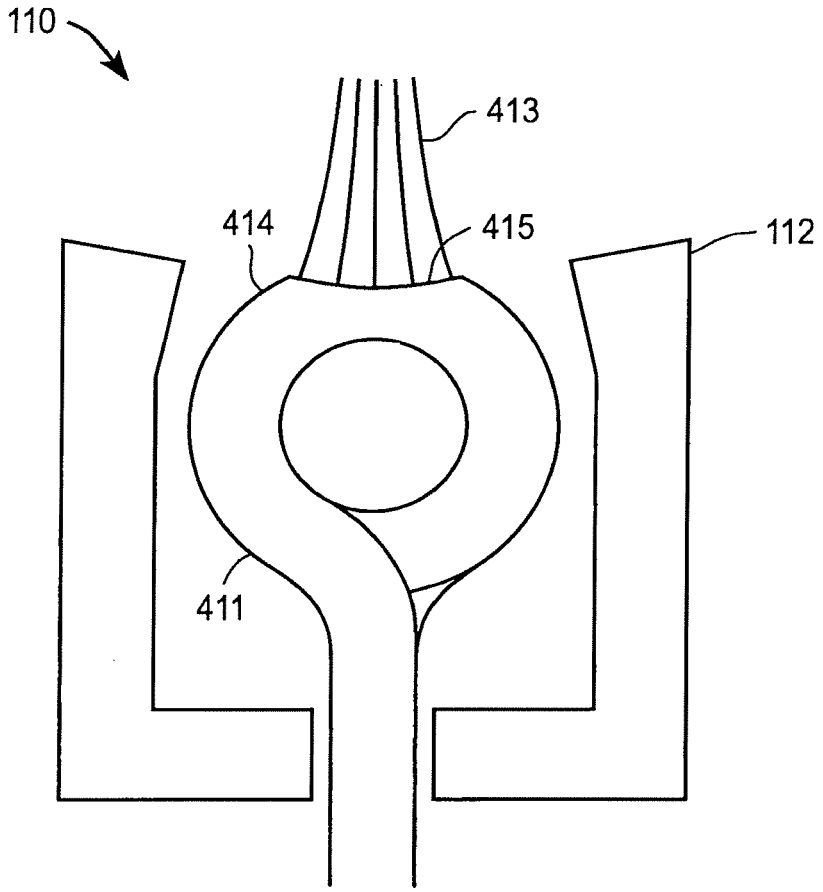
FIG. 4*a* illustrates a longitudinal view of one embodiment of a cylindrical filament coil, which has a concave curvature on the selected portion of the surface.
Figure 4B:
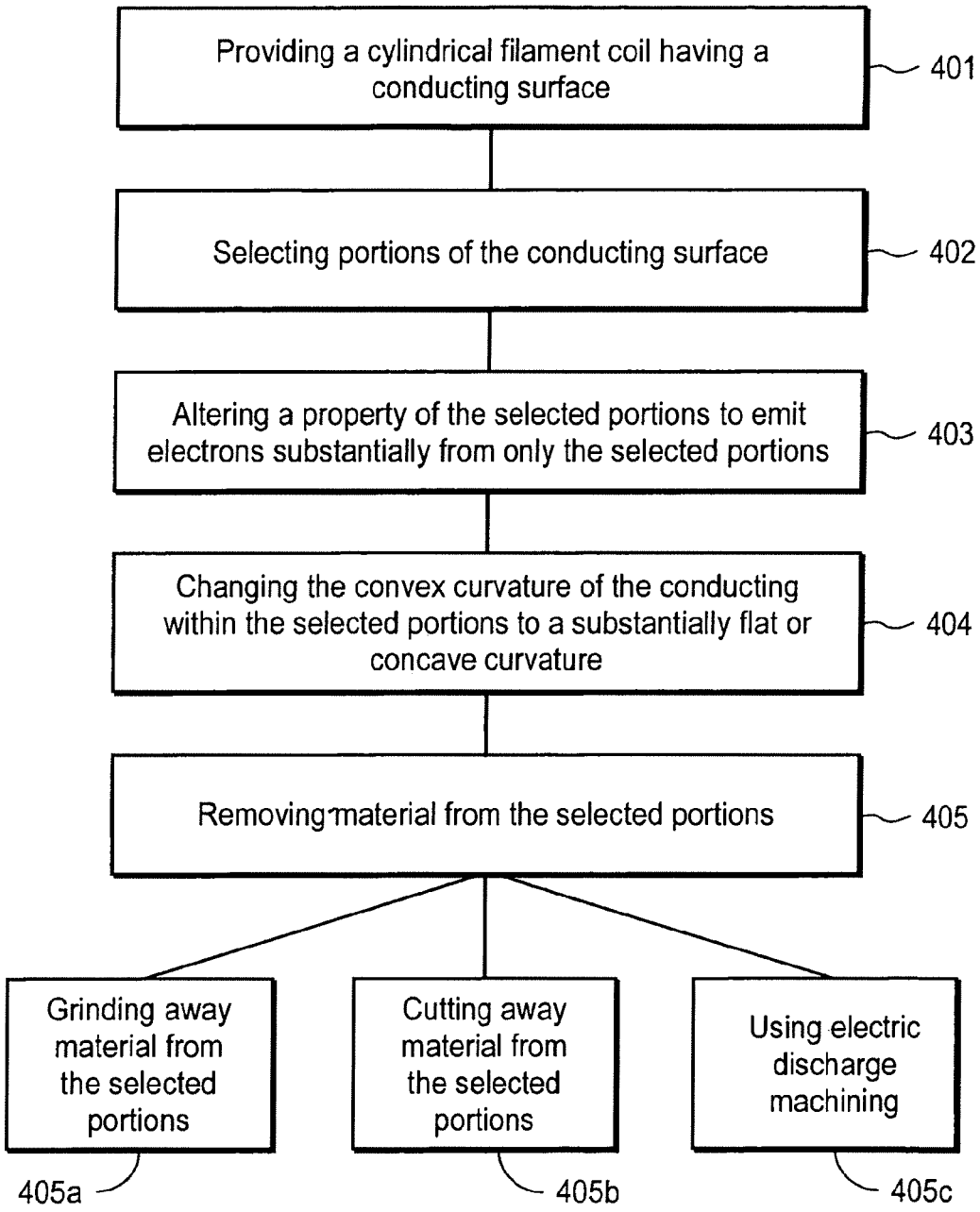
FIG. 4*b* illustrates one embodiment of a method for changing a convex curvature of the surface within the selected portions to a substantially flat or concave curvature.
Figure 5A:
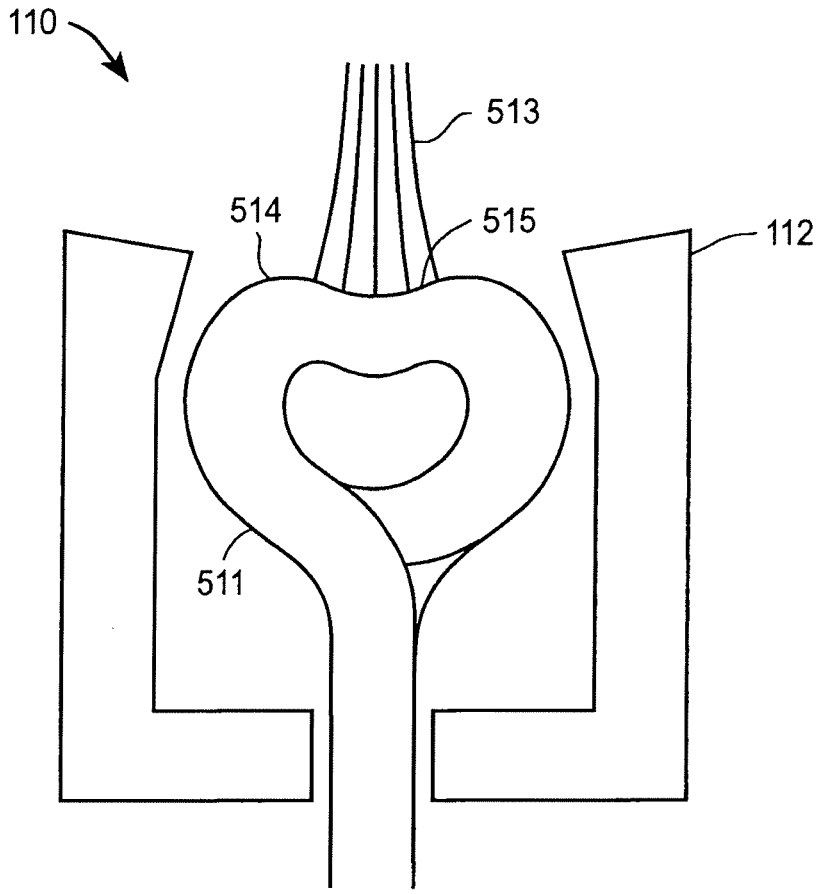
FIG. 5*a* illustrates a longitudinal view of another embodiment of a cylindrical filament coil, which has a concave curvature on the selected portion of the surface.
Figure 5B:
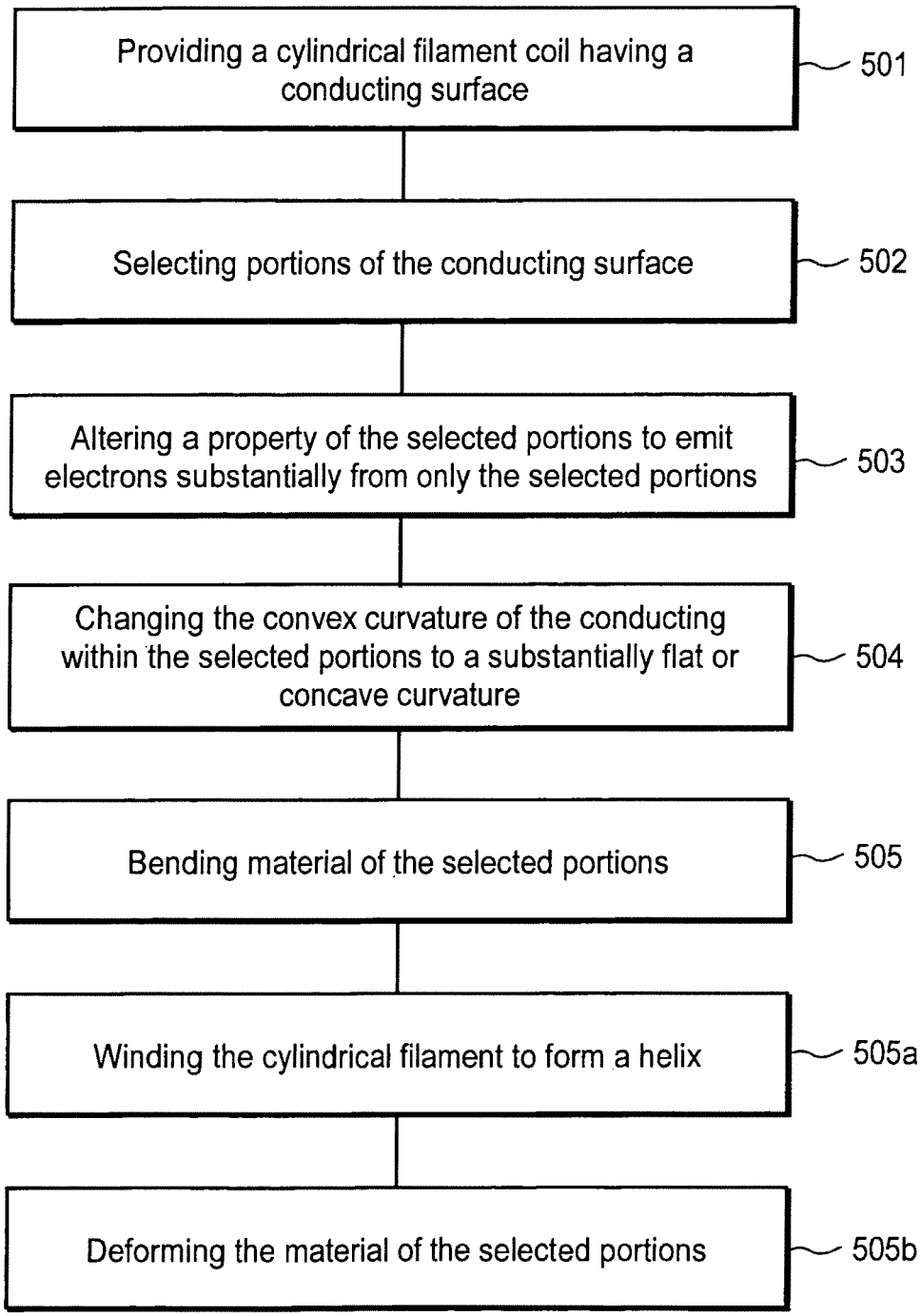
FIG. 5*b* illustrates another embodiment of a method for changing a convex curvature of the surface within the selected portions to a substantially flat or concave curvature.

In one embodiment, altering properties of selected portions of the cylindrical filament 111 may be accomplished by providing a surface of a cylindrical filament coiled in a helix to serve in the cathode structure 110 of an X-ray tube 100, selecting portions of the surface of the cylindrical filament, and altering a geometric property of the selected portions to favor the trajectories of electrons emitted from the selected portions. Altering the property of the selected portions may include changing the convex curvature along the selected portions of the surface of the filament 111 to a substantially flat or concave shape. Examples of steps to achieve the geometrical changes required are illustrated in FIGS. 4*a* and 5*a* and the steps 401-403 and 501-503 of FIGS. 4*b* and 5*b*, respectively. Convex curvature, as referred herein, means that the envelope of the coiled filament tangent to its surface have a convex curvature from the center of the cylindrical filament 111 facing the anode 120.

Changing the convex curvature of the selected portions may be accomplished by removing material from the selected portions to form a substantially flat or concave curvature, step 405, for example by grinding away the material from the selected portions, step 405*a*. In alternate embodiments, removing material from the selected portions may be performed by other methods, for example, cutting away material from the selected portions, step 405*b*, by electric discharge machining, step 405*c*, or by other methods known to those of ordinary skill in the art, for example, etching. It should be noted that changing the convex curvature of the selected portions of the cylindrical filament 111 may be performed before or after winding the cylindrical filament 111 into a coiled helix.

In another embodiment (see FIG. 5*a*), changing the convex curvature of the selected portions may include bending material from its convex shape into a substantially flat or concave curvature, step 505. Bending material from the selected portions may include winding a cylindrical filament to form a helix, step 505*a*, and deforming the material of the selected portions to form a substantially flat or concave curvature, step 505*b*. In one exemplary embodiment, bending the material of the selected portions includes winding the cylindrical filament onto a cylindrical grooved mandrel, and deforming the material of the selected portions by pressing against the cylindrical filament coil on the cylindrical grooved mandrel with a wedge. The wedge has a desired shape to deform the material of the selected portions of the cylindrical filament coil to form a substantially flat or concave curvature on the selected portions of the surface of the cylindrical filament. Alternatively, bending material from the selected portions may include other methods known to those of ordinary skill in the art, for example, deforming the material of the selected portions of the cylindrical filament, step 505*b*, before winding the cylindrical filament into a coiled helix, step 505*a*.

FIG. 4*a* illustrates a longitudinal view of one embodiment of a cylindrical filament coil, which has a concave curvature on the selected portion of the surface. Cathode structure 110 of FIG. 4*a* includes a cylindrical filament 411 and filament housing structure 112. Cylindrical filament 411 includes a surface, which has a non-selected portion 414 and a selected portion 415. It should be noted that FIG. 4*a* illustrates a view of a cylindrical filament, coiled in a helix, along the axis of the helix and thus, illustrates one coil of the cylindrical filament 411. In general, this shaping may extend to more than one coil of the cylindrical filament 411, and may even include all of the coils.

As described previously, when sufficient current passes through the cylindrical filament 411, to heat it to a sufficient temperature, the cylindrical filament 411 of the cathode structure 110 emits electrons towards the anode 120 forming an electron beam 413. In this embodiment, the altered property of the selected portion 415 of the surface is a curvature. When material is removed from the selected portion 415, step 405, the non-selected portion 414 forms the boundary of the portion having altered curvature. The curvature along the selected portion 415 may be substantially flat or concave.

As previously discussed, in alternate embodiments, removing material may be performed by grinding or cutting the material away from the selected portion 415, steps 405*a* and 405*b*, respectively, allowing the non-selected portion 414 to form the boundary of the region of desired curvature. As previously mentioned, the cylindrical filament 411 may include additional coils, and thus, the aforementioned methods of removing material may be performed on additional selected portions 415 of the surface of the cylindrical filament 411.

Removal of material from selected portions 415 of the surface in step 405, the area of the cross section of the wire below the selected portions 415 may decrease, thereby increasing the local current density in the filament which will increase the temperature produced by the current in the area below the selected portions 415 of the surface, and will decrease the temperature produced by the current in the area below the non-selected portions 414 of the surface. This may allow the selected portions 415 of the surface to release electrons more easily, due to the higher temperature there, than will be released by the non-selected portions 414 of the surface. Reducing the temperature of the non-selected portions 414 of the surface and the corresponding areas below the surface, may reduce the mechanical stress on the non-selected portions 414 and thereby increase the life of the cylindrical filament 411.

For illustrative purposes, in one embodiment, by removal of material from the selected portions 415 of the surface in step 405, the emitting surface radius of the curvature of the emitting surface is formed by removal of approximately one half the diameter of the cylindrical filament wire 411.

It has been noted that removal of material from selected portions 415 of the filament as described above will result in a higher local current density and thus a higher local temperature that will promote a desirable higher electron emission from the selected portions 415 without a concomitant increase in the electron emission from the unselected portions 414 of the filament. The current density in the unselected portions 414 of the filament produces a lower temperature in those portions, thereby reducing, as said above, the stress in those portions which can extent the life of the filament 411.

FIG. 5*a* illustrates a longitudinal view of another embodiment of a cylindrical filament coil, which has a concave curvature on the selected portion 515 of the surface. Concave curvature, for purposes herein, refers to the curvature of the envelope surface of the coiled filament. Cathode structure 110 of FIG. 5*a* includes a coiled cylindrical filament 511 and filament housing structure 112. Cylindrical filament 511 includes a surface, which has a non-selected portion 514 and a selected portion 515. It should be noted that FIG. 5*a* illustrates a view of a cylindrical filament, coiled in a helix, along the axis of the helix and thus, illustrates one coil of the cylindrical filament 511. In general, this shaping may extend to more than one coil of the cylindrical filament 511, and may even include all of the coils.

As previously described, when current passes through the cylindrical filament 511, the cylindrical filament 511 of the cathode structure 110 emits electrons towards the anode 120 forming an electron beam 513. In this embodiment, the altered property of the selected portion 515 of the surface is the envelope curvature. By bending the material of selected portion 515 in step 505, the selected portion 515 forms the desired envelope curvature, meaning the original material of the selected portions 515 remains intact and merely changes position with respect to the non-selected portions 514. The envelope curvature formed along the selected portion 515 may be substantially flat or concave.

As previously discussed, in one embodiment, bending material of the selected portions, step 505, may be performed by winding the cylindrical filament 511, step 505*a*, onto a cylindrical grooved mandrel, and deforming the material of the selected portions 515 of the surface, step 505*b*, by pressing against the cylindrical filament 511 on the cylindrical grooved mandrel with a wedge which has a desired shape to deform the material of the selected portions 515 of the cylindrical filament 511. The deformed material may have a substantially flat or concave envelope curvature on the selected portions 515 of the surface of the cylindrical filament. Alternatively, other known methods of bending material may be used, for example, deforming the material of the selected portions 515 of the cylindrical filament, step 505*b*, before winding the cylindrical filament 511 into a coiled helix, step 505*a*.

As previously mentioned, the cylindrical filament 511 may include additional coils, and thus, the aforementioned methods of bending material may be performed on additional selected portions of the surface of the cylindrical filament 511.

In one embodiment, by bending material of the selected portions 515 of the surface in step 505, the radius of curvature of the envelope of the emitting surfaces in the selected portions 515 of the filament may be half the diameter of the coil of the cylindrical filament 511. In other embodiments, by appropriate deforming steps on the filament 514 of the surface in step 505, the envelope surface radius of the curvature within the selected portions 515 of the surface may be made greater or smaller than this value.

Figure 6:
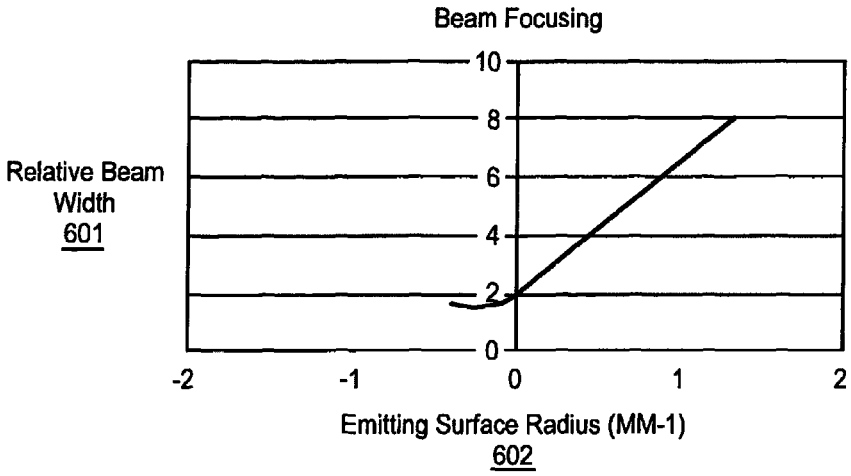
FIG. 6 displays a graph illustrating the relative beam width with respect to the emitting surface radius of the curvature of the selected portions of the surface.

FIG. 6 is an exemplary graph showing the relationship of the beam width of an electron beam to the radius of curvature of the emitting surface reciprocal of the selected portions of the shaped electron emitting filament. Graph 600 illustrates one exemplary embodiment of how the relative beam width 601, the ordinate, changes with respect to the emitting surface radius 602, the abscissa, of the curvature of the selected portions of the surface. In the graph 600, the emitting surface radius 602 is represented in inverse millimeters ($mm^{-1}$), and the related beam width 601 is represented in millimeters. For the sign convention of the emitting surface radius 602, positive numbers represent a convex curvature, negative numbers represent a concave curvature, and zero represents a flat curvature. Alternatively, other sign conventions and units known to those skilled in the art may be used. The beam width depends on the overall geometry of the X-ray tube as well as the curvature of the electron emitting surface. The width of the beam in FIG. 6 is defined at the footprint on the anode.

As illustrated in this exemplary embodiment, as the reciprocal radius 602 of the emitting surface decreases from a positive number to zero the relative beam width 601 decreases. Similarly, as the reciprocal radius 602 decreases further from zero to a negative number the relative beam width 601 further decreases. In this exemplary embodiment, a positive number represents a convex curvature, a negative number represents a concave curvature, and zero represents a flat surface reciprocal. By way of illustration, in the specific case represented in graph 600, when the emitting surface reciprocal 602 has a curvature of positive 0.763 millimeters (0.763=1/1.31), the relative beam width 601 has a value of 8 millimeters; when the emitting surface 602 has a curvature of zero, the relative beam width 601 has a value of 2 millimeters; and when the emitting surface reciprocal 602 has a curvature of negative 2.56 millimeters (−2.56=1/(−0.39)), the relative beam width 601 has a value of 1.5 millimeters.

In addition to the influence of the geometry of the cathode structure in the descriptions above, the current density of the electron beam may also be influenced by the work function of the electron emitting surface. FIGS. 7*a*-7*d* are longitudinal views illustrating embodiments of one coil of a cylindrical filament 711 including a surface, which has a non-selected portion 714 and a selected portion 715. Alternatively, cylindrical filament 711 may include more than one coil, which coils may have one or more selected and/or non-selected portions of the surface of the cylindrical filament 711. For ease of discussion, hereinafter the selected portion 715 and non-selected portion 714 will be referred to as selected portions 715 and non-selected portions 714. Because, the cylindrical filament 711 may include additional coils, the methods of changing a work function described below may be performed on one or more selected and non-selected portions 715 and 714 of the surface of the cylindrical filament 711.

In one embodiment, altering properties of selected portions 715 of the cylindrical filament 711 may be accomplished by providing a surface of a cylindrical filament coiled in a helix for cathode 110 of X-ray tube 100, step 701, selecting portions 715 of the surface of the cylindrical filament 711, step 702, and altering a property of the selected portions 715 to emit electrons substantially from only the selected portions 715, step 703. Altering the property of the selected portions 715 may include changing the work function of the selected portions 715 with respect to the non-selected portions 714 of the surface of the cylindrical filament, step 704. In alternate embodiments, altering the property of the selected portions 715 may include changing the work function of the selected portions 715, changing the work function of the non-selected portions 714, or changing the work function of the selected and non-selected portions 715 and 714 of the surface of the cylindrical filament 711.

In one embodiment, changing the work function of the selected portions 715 with respect to the non-selected portions 714 of the surface of the cylindrical filament, in this embodiment made of tungsten, step 704, may include depositing material, step 704*a*, converting/carburizing material, step 704*b*, or converting/carburizing and providing for diffusion of material, step 704*c*, described in detail below. Converting/carburizing tungsten is the process of introducing material to chemically alter tungsten to tungsten carbide (WC) or tungsten dicarbide ($W_2C$) as may be required.

Changing the work function of the selected portions 715, the non-selected portions 714, or both the selected and non-selected portions 715 and 714, such that the selected portions 715 have a lower work function that the non-selected portions 714, may increase the number of electrons emitted from the selected portions 715 of the surface. The increase in the number of electrons emitted from the selected portions 715 may increase the intensity of the electron beam emitted from the coiled cylindrical filament 711 of cathode structure 110 towards anode 120. The increase in the number of electrons emitted from the selected portions 715 may be accompanied by a decrease the width of the electron beam, which may decrease the width of the electron beam footprint incident on the anode 120.

In one exemplary embodiment, the difference between the work function of the selected portions 715 and of the non-selected portions 714 is approximately two tenths of an electron volt (0.2 eV). Alternatively, other work function differences may be used, for example, more or less than one electron volt (1 eV), up to two and four tenths electron volt (2.4 eV). In another exemplary embodiment, the difference between the work function of the selected portions 715 and of the non-selected portions 714 may range from 0.2 eV to 2.4 eV. Alternatively, other ranges may be used.

Figure 7A:
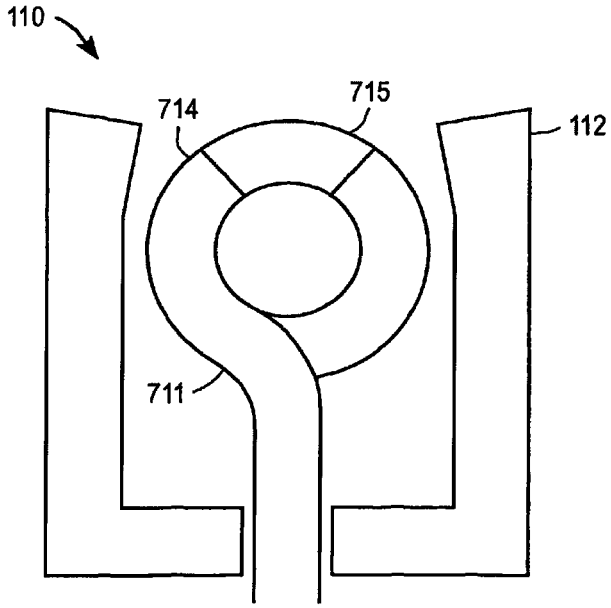
FIG. 7*a* illustrates a longitudinal view of one embodiment of a cylindrical filament coil, showing boundaries for selected and non-selected portions of the surface.

FIG. 7*a* illustrates a longitudinal view of one embodiment of a cylindrical filament coil, which has a surface. Cathode structure 110 of FIG. 7*a* includes a cylindrical filament 711 and filament housing structure 112. Cylindrical filament 711 includes a surface, which has non-selected portions 714 and selected portions 715. As described previously, when current passes through the cylindrical filament 711, the cylindrical filament 711 of the cathode structure 110 is heated to a point that enables emission of electrons towards the anode 120 (not shown) forming an electron beam. In this embodiment, the altered property of the selected portions 715 of the surface is the work function.

As described above, filament 711 may be a cylindrical filament coiled in a helix, installed in the cathode structure 110 of an X-ray tube 100, which has a surface. The surface may have selected portions 715 with an altered property with respect to the non-selected portions 714 of the surface. In this embodiment, the altered property of the selected portions 715 of the surface may be the work function. In this embodiment, moreover, the selected portions 715 of the surface have a lower work function than the non-selected portions 714 of the surface of the cylindrical filament 711.

As described in more detail below, changing the work function, such that the selected portions 715 have a lower work function that the non-selected portions 714, may include changing the work function of selected portions 715, changing the work function of the non-selected portions 714, or changing the work function of both the selected and non-selected portions 715 and 714 of the surface.

Figure 7B:
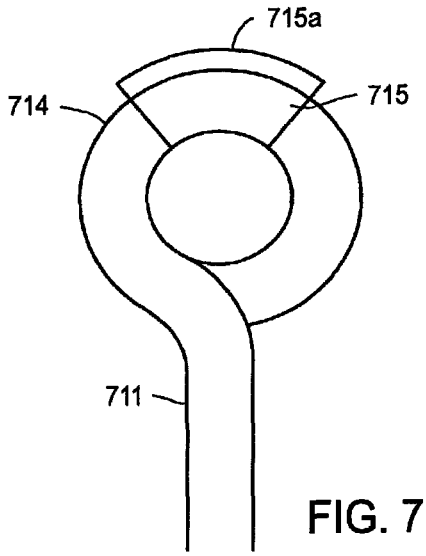
FIG. 7*b* illustrates a longitudinal view of one embodiment of depositing material on selected portions of the surface of a cylindrical filament coil.

FIG. 7*b* illustrates a longitudinal view of one embodiment of having material deposited on selected portions of the surface of a cylindrical filament coil to change the work function. In one embodiment, changing the work function of the selected portions 715, step 704*a*, may include depositing a film layer of material 715*a* on the selected portions 715 of the surface of the base filament material, step 720.

In one embodiment, the film layer of material 715*a* is tantalum and the base filament material of the selected and non-selected portions 715 and 714 is tungsten. Tantalum has a work function of approximately 4.1 eV and tungsten has a work function of approximately 4.5 eV, resulting in a work function differential of approximately 0.4 eV. Alternatively, other materials known to those skilled in the art can be used for the film layer of material 715*a* and the base filament material, such that the film layer of material 715*a* has a lower work function than the base filament material of the non-selected portions 714 of the surface.

In one exemplary embodiment, the difference between the work function of the film layer of material 715*a* coating the selected portions 715 and of the non-selected portions 714 is approximately four tenths (0.4) eV (in this example, the difference in work function for tungsten, 4.5 eV, and tantalum, 4.1 eV). This would be for a Ta film on tungsten. Alternatively, other work function differences may be used, for example, one (1) eV or less than one (1) eV. In another exemplary embodiment, the difference between the work function of the film layer of material 715*a* above the selected portions 715 and of the non-selected portions 714 may range from two tenths (2/10) eV to (1) eV. Alternatively, other ranges may be used.

Figure 7C:
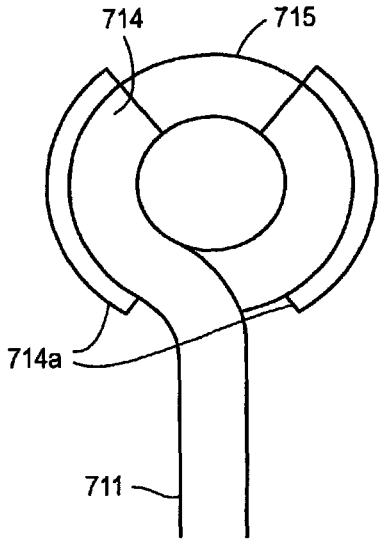
FIG. 7*c* illustrates a longitudinal view of another embodiment of depositing material on non-selected portions of the surface of a cylindrical filament coil.

FIG. 7*c* illustrates a longitudinal view of another embodiment of depositing material on non-selected portions of the surface of a cylindrical filament coil. In one embodiment, changing the work function of the non-selected portions 714, step 704*a*, may include depositing a film layer of material 714*a* on non-selected portions 714 of the surface, which comprises the base filament material, step 721. In alternate embodiments, changing the work function of non-selected portions 714 may include depositing a first film layer of material 714*a* on the selected and non-selected portions 715 and 714 of the surface, step 722*a*, which comprises the base filament material, and removing the first film layer of material 714*a* from above the selected portions 715 of the surface, step 722*b*, resulting in a similar structure as illustrated in FIG. 7*c*; or changing the work function of non-selected portions 714 may include depositing a first film layer of material 715*a* on the selected and non-selected portions 715 and 714 of the surface, step 722*a*, removing the first film layer of material 715*a* from above the non-selected portions 714 of the surface, step 722*c*, resulting in a similar structure as illustrated in FIG. 7*b*.

In one exemplary embodiment, the film layer of material 714*a* is platinum and the base filament material of the selected and non-selected portions 715 and 714 is tungsten. Platinum has a work function of approximately 5 eV and tungsten has a work function of approximately 4.5 eV, resulting in a work function differential of approximately 0.5 eV. Alternatively, other materials known to those skilled in the art can be used for the film layer of material 714*a* and the base filament material of the selected and non-selected portions 715 and 714, such that the film layer of material 714*a* has a higher work function than the base filament material.

In another embodiment, the difference between the work function of the selected portions 715 and the film layer of material 714*a* on non-selected portions 714 of the surface is approximately four tenths 0.4 eV (for Ta on tungsten). Other work function differences may be used, for example, one 1 eV or less than one 1 eV. In another exemplary embodiment, the difference between the work function of the film layer of material 714*a* above the non-selected portions 714 and of the selected portions 715 may range from 0.2 eV to 1 eV. Alternatively, other ranges may be used.

Figure 7D:
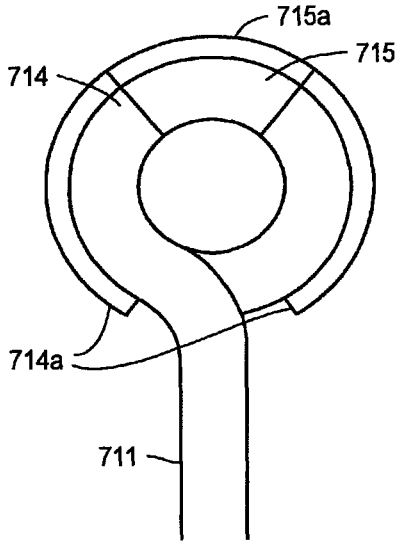
FIG. 7*d* illustrates a longitudinal view of another embodiment of depositing material on both the selected and non-selected portions of the surface of a cylindrical filament coil.
Figure 7E:
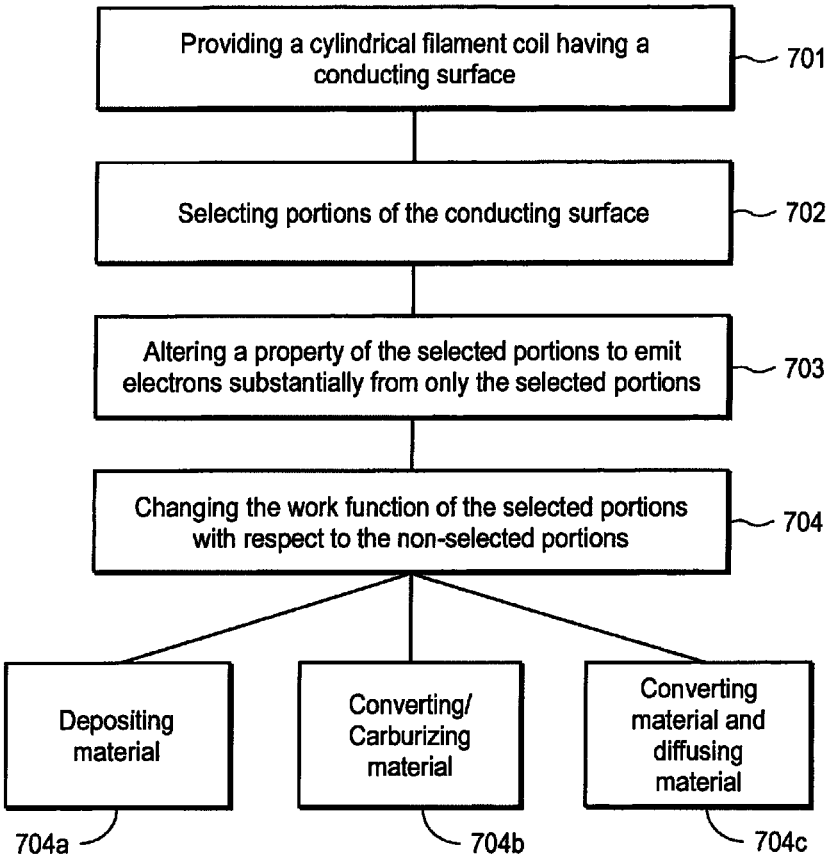
FIG. 7*e* illustrates one embodiment of a method for changing a work function of the selected portions with respect to the non-selected portions of a surface.
Figure 7F:
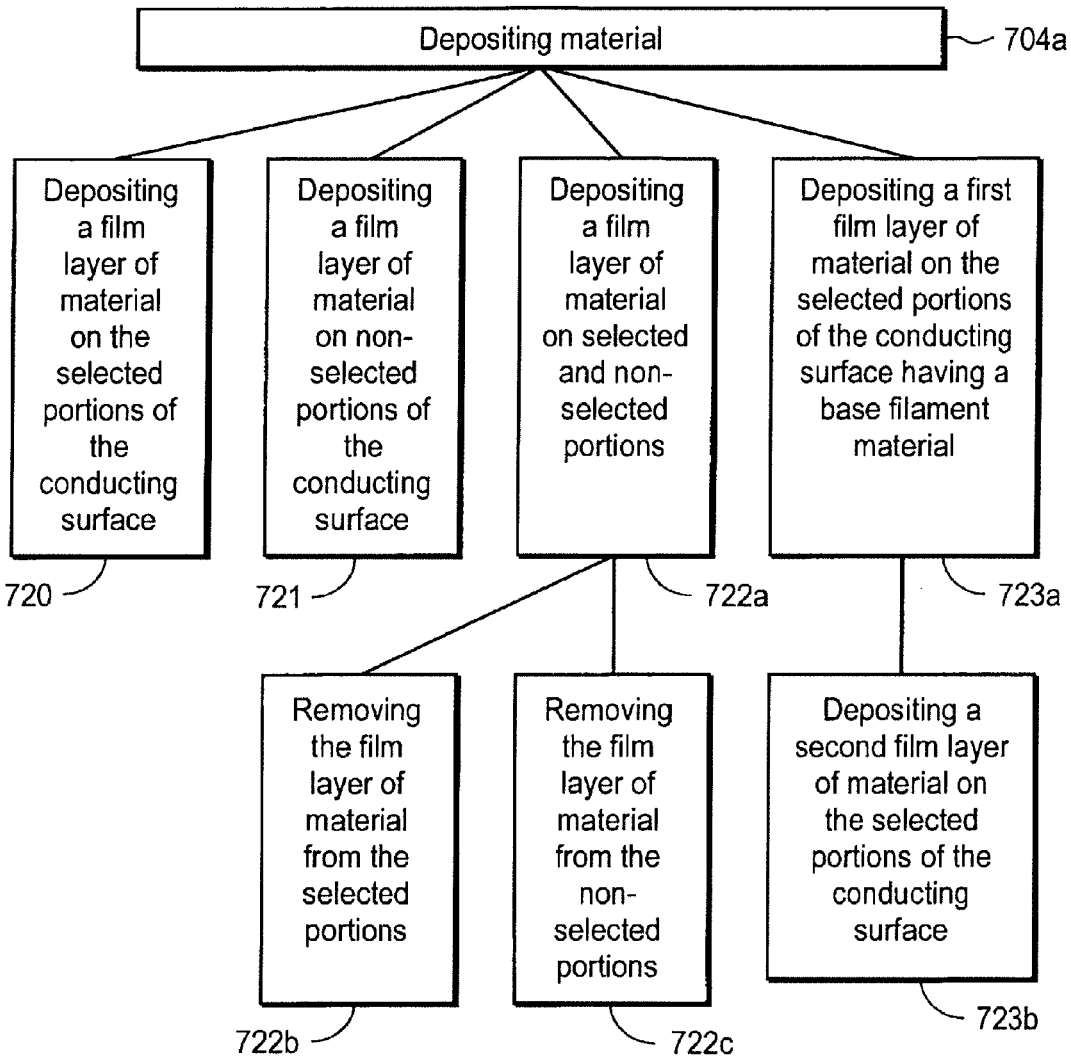
FIG. 7*f* illustrates one embodiment of a method for depositing material on a surface of a coiled filament.
Figure 7G:
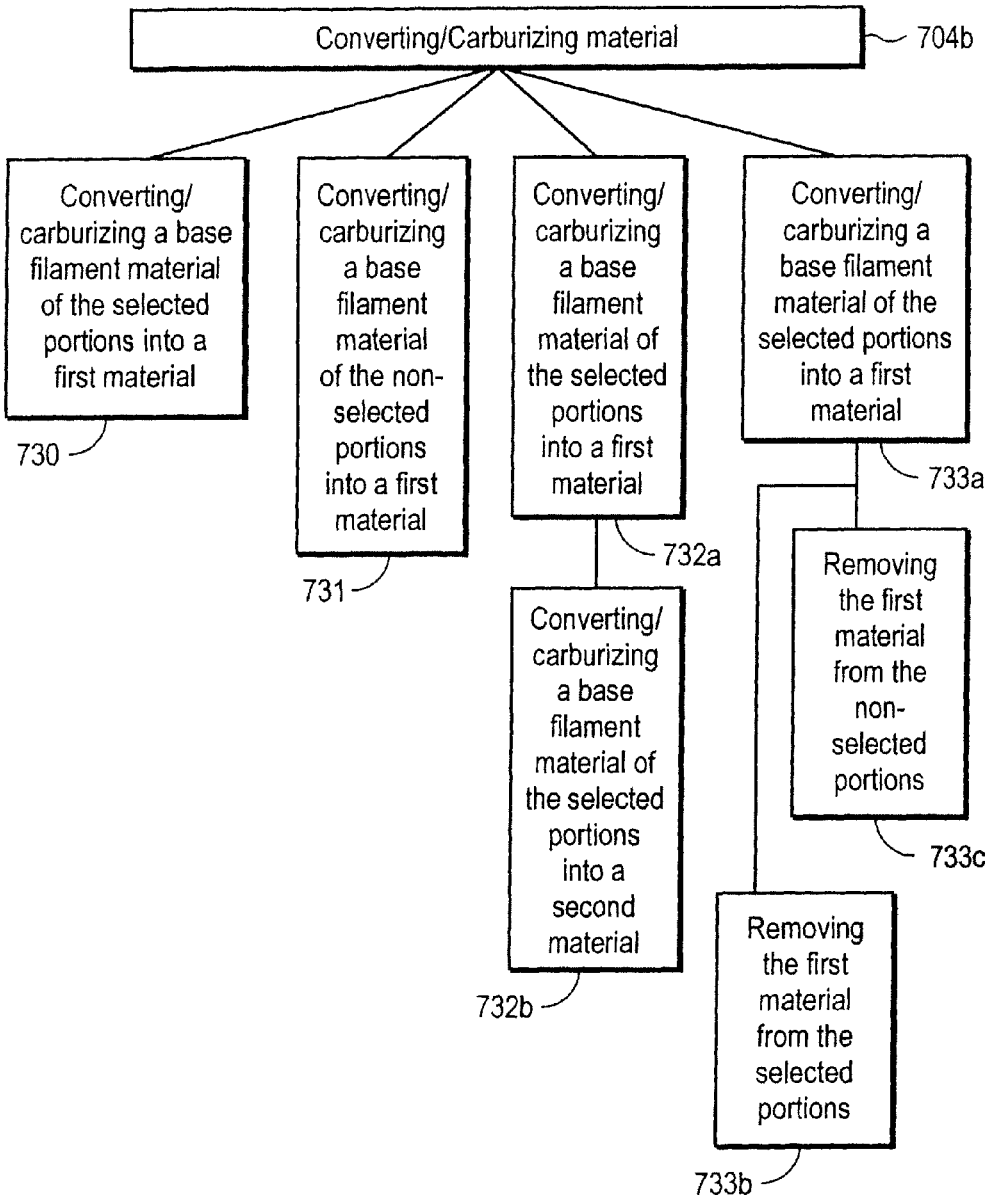
FIG. 7*g* illustrates one embodiment of a method for converting/carburizing material of a surface of a coiled filament.
Figure 7H:
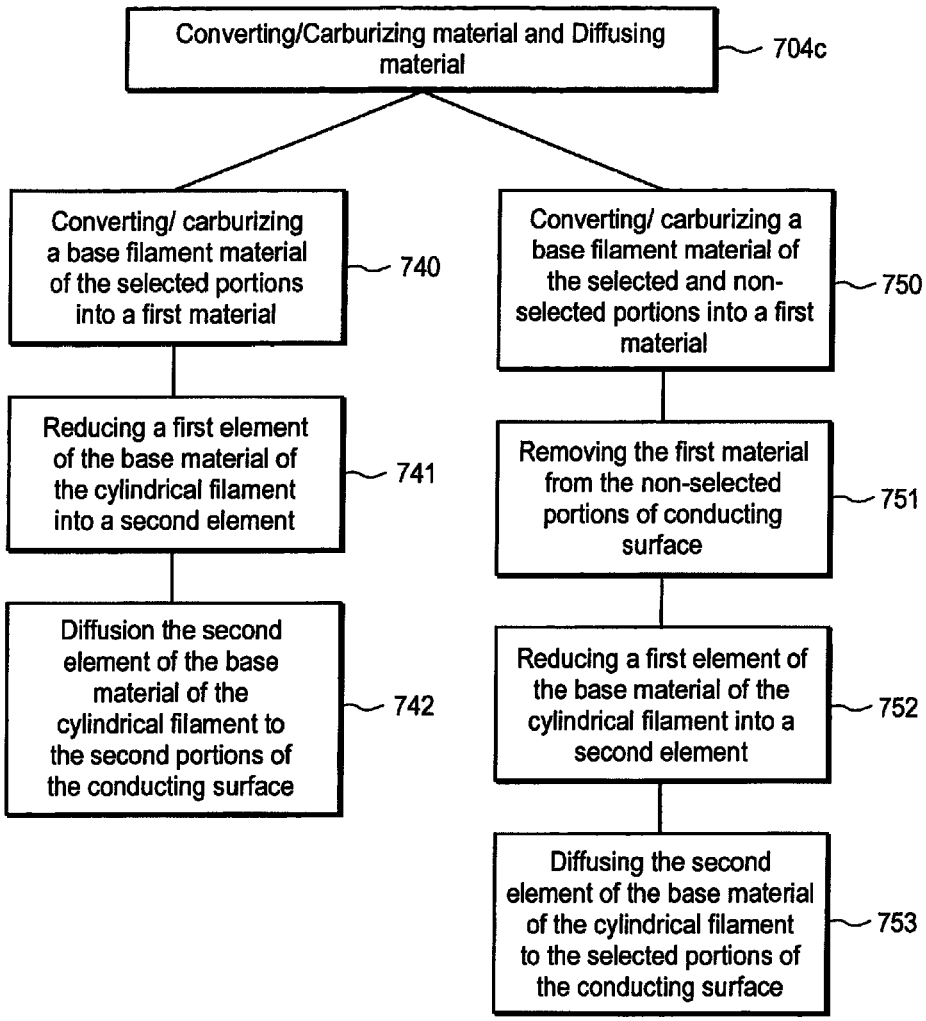
FIG. 7*h* illustrates one embodiment of a method for converting/carburizing and diffusing material of a surface of a coiled filament.

FIG. 7*d* illustrates a longitudinal view of another embodiment of depositing material on both the selected and non-selected portions of the surface of a cylindrical filament coil. In one embodiment, changing the work function of both the selected and non-selected portions 715 and 714 may include depositing a first film layer of material 715*a* on the selected portions 715 of the surface, step 723*a*, which has a base filament material, and depositing a second film layer of material 714*a* on non-selected portions 714 of the surface, step 723*b*. In one embodiment, changing the work function of the filament, which is of the basic filament material, of both the selected the non-selected portions 715 and 714 may include depositing a first film layer of material 715*a* on the selected portions 715 of the surface, step 723*a*, and depositing a second film layer 714 on non-selected portions 714 of the surface, step 723*b*.

In one exemplary embodiment, the first film layer of material 715*a* is tantalum, the second film layer of material 714*a* is platinum, and the base filament material of the selected and non-selected portions 715 and 714 is tungsten. Alternatively, other materials known to those skilled in the art can be used for the first film layer of material 715*a*, the second film layer of material 714*a*, and the base filament material of the selected and non-selected portions 715 and 714, such that the first film layer of material 715*a* has a lower work function than the second film layer of material 714*a*.

In one embodiment, the difference between the work function of the first film layer of material 715*a* above the selected portions 715 and the second film layer of material 714*a* above the non-selected portions 714 is approximately 0.2 eV. Alternatively, other work function differences may be used, for example, 1 eV or less than 1 eV. In another exemplary embodiment, the difference between the work function of the film layer of material 714*a* above the non-selected portions 714 and the film layer of material 715*a* above the selected portions 715 may range from 0.2 eV to 1 eV. Alternatively, other ranges may be used.

It should be noted that in the methods described herein with respect to depositing material on the base filament material, the materials used for depositing on the base filament materials should be compatible with the thermal and physical requirements for operation in an X-ray tube 100, for example, proper care should be taken to ensure that good film adherence is maintained over a range of approximately two thousand degrees)(~2000°) Kelvin, and that the deposited material does not disappear by vaporization at the operating temperature of the filament of the X-ray tube 100, or by diffusion into the bulk material of the cylindrical filament 711 before the intended end of life of the filament.

In another embodiment, changing the work function of the selected portions 715, step 704*b*, may include converting a base filament material of the selected portions 715 into a first material which may be a chemical compound of the base filament material and an added material, step 730.

Converting a base filament material to provide preferred areas of electron emission may include converting by carburizing the base filament material of the selected portion 715 of the surface into a first material that has a lower work function than the noncarburized base filament material, step 730. Some alternate examples of means to provide for preferred areas of lower work function follow. For a first example, converting the non-selected portions of the base filament surface 714 into a first altered material, step 731, wherein the altered material has a higher work function than the base filament material left exposed in the selected portion of the filament. For a second example, converting the selected portions of the base filament surface 715 into a first altered material, step 732*a*, and converting the non-selected portions of the base filament surface 714 into a second altered material, step 732*b*, wherein the second altered material has a higher work function than the first altered material. For a third example, converting the base filament surface into a first altered material, step 733*a*, wherein the first altered material has a higher work function than the base filament material, and then removing the first material from the region defining the selected portion 715, step 733*b*. For a fourth example, converting the base filament surface into a first altered material, step 733*a*, wherein the first altered material has a lower work function than the base filament material, and then removing the converted base filament material from the non-selected portions 714, step 733*c*. The base filament material may be tungsten, and the converted chemically compounded material of the selected portions 715 may be tungsten carbide, WC, or tungsten dicarbide, $W_2C$. It is noted that tungsten has a work function of 4.5 eV, WC has a work function of 3.6 eV and $W_2C$ has a work function of 4.58 eV. These differences can be exploited to localize different areas of electron emission. While the carbides of tungsten are cited, other materials known to those skilled in the art can be used for the base filament material such that the resulting altered surface material of selected portions 715 of the surface has a lower work function when compared to the base filament material.

In one exemplary embodiment, by compounding the tungsten with carbon over the selected portions 715 and nonselected portions 714 to provide compounding to WC and $W_2C$ respectively of the surface in steps 730 and 731 respectively, the difference in work functions between the selected and non-selected portions 715 and 714 results in a work function differential of approximately 0.9 eV. Alternatively, other materials known to those skilled in the art can be used for the first material and the base filament material, such that the first material has a lower work function than the base filament material.

In another exemplary embodiment, changing the work function of the non-selected portions 714 of the surface may include converting W of the non-selected portions 714 into $W_2C$, step 731. Alternatively, other materials known to those skilled in the art can be used for the first material and the base filament material, such that the first material has a higher work function than the base filament material.

In another exemplary embodiment, changing the work function of the selected and non-selected portions 715 and 714 may include converting W of the selected portions 715 into WC in step 732*a*, and converting the W of the non-selected 714 portions into $W_2C$ in step 732*b*. Alternatively, other materials known to those skilled in the art can be used for the first material, the second material, and the base filament material, such that the first material has a lower work function than the second material.

It should be noted that by converting the surface to one chemical compound, and then converting the resulting material to another chemical compound, the converted material may become immune to de-lamination, evaporation, and diffusion throughout the filament temperature range.

In another embodiment, changing the work function of the selected portions 715, step 704*c*, may include use of a base filament material which incorporates a first element that can be chemically manipulated. For example, introduction of thoria in a tungsten filament can provide a first element. Tungsten carbide, which can react to reduce oxides that have been incorporated in the tungsten, can be produced in the tungsten as a first material. In one example, selected portions 715 of the surface of a tungsten filament incorporating an oxide can be subjected to carburizing, thereby furnishing a first material, tungsten carbide to reduce the oxide (first element) in the selected portions, step 741, to form a reduced oxide (second element) and diffusing the second element arising from the base filament material of the cylindrical filament 711 to the selected portions 715 of the surface, step 742. Appropriate choice of elements incorporated in the base filament material can lead to the provision of a constituent that can diffuse by this process to the selected portion surface and alter the work function at that portion. Alternatively, changing the work function of the selected portions 715, step 704*c*, may include converting abuse filament material of both the selected and non-selected portions 715 and 714 of the surface into a first material, step 750, removing the first material from the non-selected portions of the surface, step 751, converting the first element of the base filament material into a second element, step 752, and diffusing the second element incorporated in the base filament material of the cylindrical filament 711 into the selected portions 715 of the surface, step 753. For example, the base filament material may be thoriated tungsten (tungsten containing a small fraction of thoria), and the first material may be thoriated tungsten carbide. In alternate embodiments, other base filament materials may be used, and selected chemical compounds may be incorporated selectively. Examples of the compounds incorporated in the cathode structure may include the lanthanide oxides which, upon incorporation in the tungsten leading to filament wire termed thoriated tungsten, ceriated tungsten, or lanthanized tungsten. Note that the means to introduce thoria, ceria, lanthanum oxide, etc., into the electron emitting cathode may include methods other than simple mixing in a manner to furnish better mechanical properties for the filament wire or other cathode structure. For example, a lanthanide could be co-sputtered in appropriate concentration with tungsten with a trace level of oxygen present. Other methods that produce the desired distribution could also be used.

In an exemplary embodiment, the base filament material is thoriated tungsten. The thoriated tungsten contains 1-2% thoria. This embodiment includes carburizing the thoriated tungsten of the selected portions 715 of the surface into a first material, tungsten carbide, in step 740. The selected portions 715 of the surface have been converted to a carburized surface, thoria in the bulk of thoriated tungsten of the cylindrical filament 711 is reduced to thorium, step 741. The thorium diffuses to the selected portions 715 of the surface, step 742. The thorium is depleted by evaporation from the selected portions 715 of the surface. The thorium lost to evaporation is continuously replaced by the continuing reduction of thoria to thorium by the tungsten carbide present in the selected portions 715 of the surface so long as there is thoria remaining incorporated in the tungsten filament.

The rate at which thoria is converted to thorium and diffused to the selected portions 715 of the surface depends on how much the selected portions 715 have been carburized. Because the non-selected portions 714 of the surface have not been carburized no thoria therein is converted to thorium in the region of the non-selected portions 714 of the surface; thus, the non-selected portions 714 of the surface contain only thoria, which will not diffuse. The selected portions 715 of the surface contain thorium which can diffuse to the surface and thereby provide, in the selected portions, a work function that is lower than the work function in the non-selected portions 714 which contain no thorium, but only thoria which does not diffuse. In this exemplary embodiment, the selected portions 715 have a work function of approximately 2.6 eV; thus, creating a very favorable work function differential of approximately 1.9 eV.

In another exemplary embodiment, the base filament material is ceriated tungsten. This embodiment includes carburizing the ceriated tungsten of the selected portions 715 of the surface into tungsten carbide, step 740. Because the selected portions 715 of the surface have been converted to a carburized surface, ceria in the bulk of cereated tungsten of the cylindrical filament 711 is reduced to cerium (Ce), step 741, which can diffuse to the surface of the selected portions 715 of the surface thereby altering the work function, step 742. The cerium eventually evaporates from the selected portions 715 of the surface; however, it is replenished from the bulk, and even though the cerium evaporates, the carburized tungsten continues to reduce the incorporated ceria remaining into cerium, and enough diffuses to the surface of the selected portions 715 of the surface to provide a steady supply of cerium to the selected portions 715 of the surface.

The rate at which ceria is converted to cerium and diffused to the selected portions 715 of the surface depends on how much the selected portions 715 have been carburized.

Because the non-selected portions 714 of the surface have not been carburized no ceria therein is converted to cerium in the region of the non-selected portions 714 of the surface; thus, the non-selected portions 714 of the surface contain only ceria which will not diffuse. Because the selected portions 715 of the surface contain cerium, the selected portions 715 have a lower work function than the non-selected portions 714, which contain only ceria which does not diffuse.

In another exemplary embodiment, the base filament material is lanthanized tungsten. This embodiment includes carburizing the lanthanized tungsten of the selected portions 715 of the surface into tungsten carbide, step 740. Because the selected portions 715 of the surface have been converted to a carburized surface, lanthanum oxide in the bulk of lanthanized tungsten of the cylindrical filament 711 is reduced to lanthanum, step 741, which can diffuse to the selected portions 715 of the surface, step 742. The lanthanum eventually evaporates from the selected portions 715 of the surface. Even though the lanthanum evaporates from the selected portions 715 of the surface, the carburized surface of the selected portions 715 continues to reduce the remaining lanthanum oxide in the bulk of the base filament material of the cylindrical filament 711 to lanthanum, providing a steady stream of lanthanum to the selected portions 715 of the surface.

The rate at which lanthanum oxide is converted to lanthanum and diffused to the selected portions 715 of the surface depends on how much the selected portions 715 have been carburized. Because the non-selected portions 714 of the surface have not been carburized no lanthanum oxide therein is converted to lanthanum in the region of the non-selected portions 714 of the surface; thus, the non-selected portions 714 of the surface contain only lanthanum oxide which will not diffuse. Because the selected portions 715 of the surface contain lanthanum, the selected portions 715 have a lower work function than the non-selected portions 714, which contain only lanthanum oxide which does not diffuse.

It should be noted that in the aforementioned embodiments, the carburized surface of the selected portions 715 is consumed. Further, the cylindrical filament 711 may become too brittle, if the selected portions 715 are carburized too much. This factor may determine the life of the cylindrical filament 711.

Figure 8:
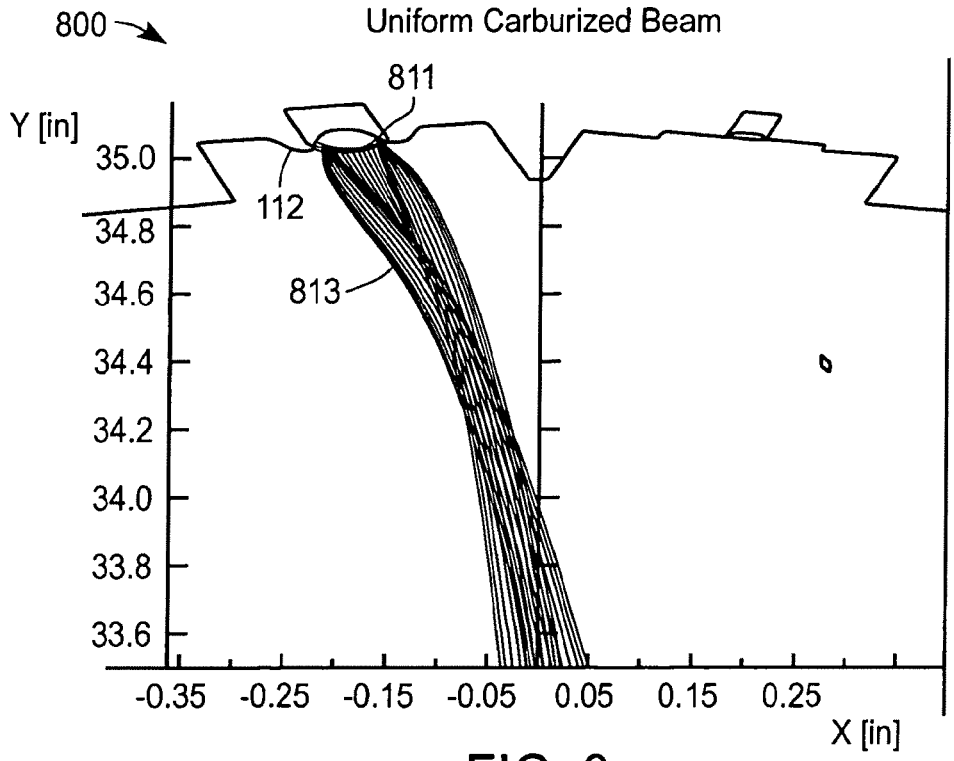
FIG. 8 illustrates an exemplary embodiment of a graph showing an electron beam emitted from a uniform carburized filament coil of a cathode to an anode in an X-ray tube.

FIG. 8 illustrates an exemplary graph showing an electron beam emitted from a uniform carburized filament coil of a cathode toward an anode (not shown) in an X-ray tube. Graph 800 shows the outline of a cylindrical filament 811 encased in the filament housing structure 112. Cylindrical filament 811 has abuse filament material. In this exemplary embodiment, the selected and non-selected portions 715 and 714 of the surface of the cylindrical filament 811 have been carburized; and thus, have the same work function. As previously described, when current passes through the cylindrical filament 811, the cylindrical filament 811 of the cathode 110 emits electrons towards the anode 120 (not shown in figure) forming an electron beam 813. The electron beam strikes the anode 120 of the X-ray tube (not shown) with a footprint corresponding to the cross section of the beam. As illustrated in graph 800, as the electron beam 813 travels farther from the cylindrical filament 811, the electrons of electron beam 813 start to spread, increasing the width of the electron beam 813, decreasing the electron beam's intensity, and increasing the width of the footprint of the electron beam incident on the anode 120.

Figure 9:
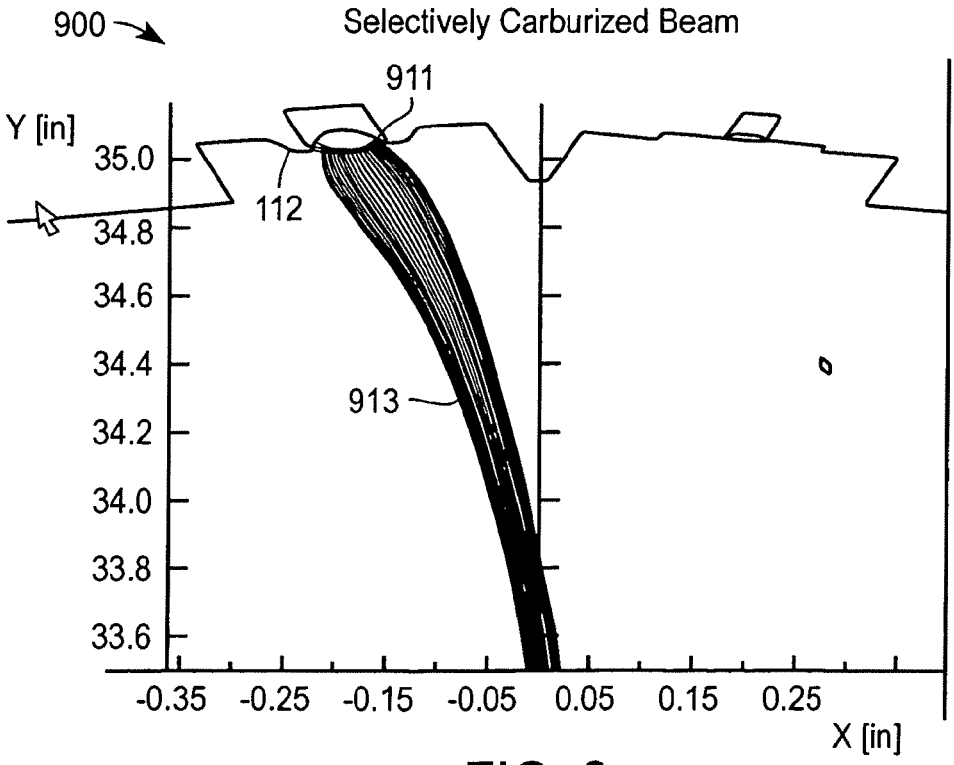
FIG. 9 illustrates an exemplary embodiment of a graph showing an electron beam emitted from a selectively carburized filament coil of a cathode to an anode in an X-ray tube.

FIG. 9 illustrates an exemplary embodiment of a graph showing an electron beam emitted from a selectively carburized filament coil of a cathode to an anode in an X-ray tube. Graph 900 shows the outline of a coiled cylindrical filament 911 encased in the filament housing structure 112. Cylindrical filament 911 has a base filament material. In this embodiment, because the selected portions 715 of the surface have been carburized and the non-selected portions 714 have not been carburized, the selected portions 715 have a lower work function than the non-selected portions 714 of the surface.

As previously described, when current passes through the cylindrical filament 911, the cylindrical filament 911 of the cathode 110 emits electrons towards the anode 120 (not shown in figure) forming an electron beam 913. Comparing the electron beam 913 with the electron beam 813 of FIG. 8, as the electron beam 913 travels away from the cylindrical filament 911, the electron beam 913 has a smaller electron beam width than the electron beam width of the electron beam 813. The electron beam 913 experiences a smaller spreading effect than the electron beam 813 of FIG. 8. The electron beam 913 incident on anode 120 has a smaller footprint than the width of the electron beam 813 incident on anode 120, and has a more uniform distribution of electrons than the electron beam 813 incident on anode 120. While the electron beam 813 incident on anode 120 may have a high concentration of electrons towards the center of the electron beam 813 incident on anode 120, it has a diverging distribution of electron density with no sharp boundary of electrons approaching the edges of the electron beam 813 incident on anode 120 caused by the spreading effect as described in relation to FIG. 8. This non-uniform distribution of electrons of the electron beam 813 incident on anode 120 with a spreading footprint may result in fuzzy or blurry X-ray images because the electron beam 813 applies a varying electron beam intensity in different regions of the electron beam 813 as it impinges on the anode 120.

Conversely, electron beam 913 has a substantially uniform distribution of electrons striking the anode, which may sharpen the edges of the electron beam 913 incident on anode 120 and provide uniform distribution of beam intensity within the electron beam 913 incident on anode 120. Sharp edges and uniform distribution of energy within the electron beam 913 incident on anode 120 will result in a smaller and better defined spot size on the anode, thus generating sharper X-ray images. Further, by increasing the uniformity distribution of electrons within the electron beam 913 incident on anode 120 and sharpening its edges, the cathode structure 110 may deposit the full intensity of the electron beam in a desired location on the anode 120. This condition results in a footprint of electrons on the anode with a smaller width, a greater intensity, and sharper edges than was the case of the electron beam 813 of FIG. 8.

Figure 10:
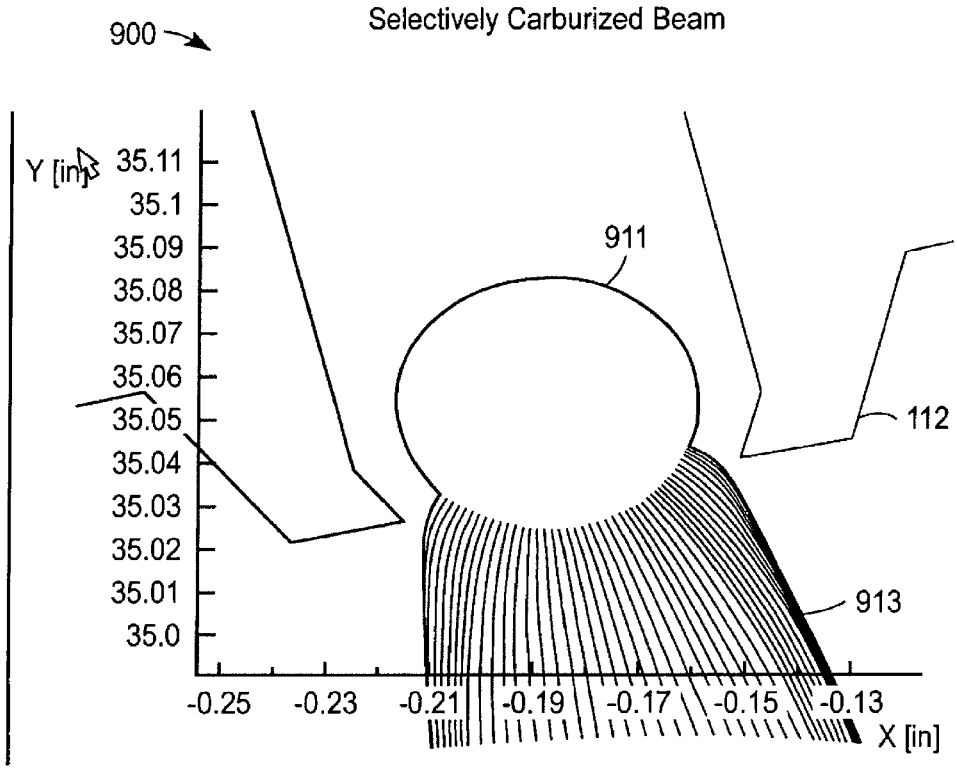
FIG. 10 illustrates a close-up view of the electron beam emitted from the selectively carburized filament coil to the anode of FIG. 9.

FIG. 10 illustrates a close-up view of the electron beam emitted from the selectively carburized filament coil to the anode of FIG. 9. Graph 900 of FIG. 10 depicts cylindrical filament 911 encased in the filament housing structure 112. As previously described, in this embodiment, cylindrical filament 911 has a base filament material which can be tungsten. In this example, selected portions 715 of the surface of the cylindrical filament 911 have been carburized, resulting in a lower work function for the selected portions 715 than the non-selected portions 714. As previously described, when current passes through the cylindrical filament 911, the cylindrical filament 911 of the cathode structure 110 is heated and emits electrons towards the anode 120 (not shown in figure) forming an electron beam 913. It should be noted that as electrons travel from the cathode 110 to the anode 120 they increase in energy. As the electrons in the beam 913 are accelerated, the tendency for the beam to spread depends in part on the points of origin of the electrons. In particular, the size and orientation of the emitting surface 715 of the filament will influence the beam width and the size of its footprint. Due to the increase in energy the shape of the electron beam 913, which determines the width of the electron beam 913 incident on anode 120, becomes harder to control using electric fields as the electron beam 913 travels away from the cathode 110 to the anode 120. Definition of the emitting area of the cylindrical filament 911 by carburizing selected portions 715 of the cylindrical filament 911 or by other means may allow more accurate control of the shape of the electron beam 913 incident on anode 120 than is the case for an untreated cylindrical filament. The selected portions 715 of the cylindrical filament 911 can reduce the spread of the electron beam 913 by confining the emission primarily to the smaller fling area 715 because of its lower work function compared to the surrounding area 714.

Note that although specific examples of cathode structures, namely coiled cylindrical filaments, have been described above, other heated shapes may be used. For example, ribbon filaments which may be more suitable for deformation to the desired curvature may be used. Moreover, the heating of the cathode shapes may, alternatively, be by indirect means, such as electron bombardment of the cathode structure.

In the foregoing detailed description, the method and apparatus of the present embodiments have been described with reference to specific exemplary embodiments thereof. It will, however, be evident that various modifications and changes may be made thereto without departing from the broader spirit and scope of the present embodiments. Moreover, the foregoing materials cited in the foregoing are provided by way of example as they represent the materials used in filaments. It will be appreciated that other materials may be used. Any material that otherwise satisfies the desired thermal, chemical, physical, and electrical parameters may be used. The present specification and figures are accordingly to be regarded as illustrative rather than restrictive.

What is claimed:

1. An apparatus comprising:

a cylindrical cathode filament to function as a cathode of an X-ray tube, the cathode filament comprising a top surface and an oppositely positioned bottom surface, the top surface configured to emit electrons and comprising a non-selected portion and a selected portion, wherein a work function of the selected portion of the top surface of the filament is lower than a work function of the non-selected portion of the top surface, wherein the selected portion comprises a first material, and the non-selected portion comprises a second material, and wherein one of: (1) the first material comprises thoriated ditungsten carbide (W2C/ThO2) and the second material comprises thoriated tungsten (W/ThO2), (2) the first material comprises ceriated ditungsten carbide (W2C/CeO2 or W2C/Ce2O3) and the second material comprises ceriated tungsten (W/CeO2 or W2/Ce2O3), or (3) the first material comprises lanthanaized ditungsten carbide (W2C/LaO or W2C/La2O3) and the second material comprises lanthanized tungsten (W/LaO or W/La2O3).

2. An apparatus comprising:

a cathode filament to function as a cathode of an X-ray tube, the cathode filament comprising a top surface and an oppositely positioned bottom surface, the top surface configured to emit electrons and comprising a first portion and a second portion, wherein a work function of the first portion is lower than a work function of the second portion, and wherein the first portion comprises a first material on a second material, wherein the first material comprises a first converted material, the first converted material is converted from a base filament of the second material, and wherein the first converted material comprises a carburized material, wherein the filament includes a helix shape with a part of the helix shape facing a direction having the lowered work function, and wherein one of: (1) the first material is thoriated tungsten carbide and the second material is thoriated tungsten, or (2) the first material comprises thoriated ditungsten carbide (W2C/ThO2) and the second material comprises thoriated tungsten (W/ThO2), (2) the first material comprises ceriated ditungsten carbide (W2C/CeO2 or W2C/Ce2O3) and the second material comprises ceriated tungsten (W/CeO2 or W2/Ce2O3), or (3) the first material comprises lanthanaized ditungsten carbide (W2C/LaO or W2C/La2O3) and the second material comprises lanthanized tungsten (W/LaO or W/La2O3).

3. The apparatus of claim 1, wherein the filament is a cylindrical filament coiled into a helix shape with first portions of a cylindrical surface of sections of the filament of an upward facing part of the helix shape being the first material and second portions of the cylindrical surface of the sections of the filament of a downward facing part of the helix shape being the second material.

4. The apparatus of claim 2, wherein the filament is a cylindrical filament coiled into the helix shape with a cylindrical surface of portions of the filament of an upward facing part of the helix shape being the first material.

* * * * *